US008565046B2

(12) United States Patent
Favre et al.

(10) Patent No.: US 8,565,046 B2
(45) Date of Patent: Oct. 22, 2013

(54) HAMMER FOR A WATCH STRIKING MECHANISM

(75) Inventors: Jérôme Favre, Les Bioux (CH); Patrice Golay, Le Sentier (CH)

(73) Assignee: Montres Breguet S.A., L'Abbaye (CH)

( * ) Notice: Subject to any disclaimer, the term of this patent is extended or adjusted under 35 U.S.C. 154(b) by 193 days.

(21) Appl. No.: 13/035,171

(22) Filed: Feb. 25, 2011

(65) Prior Publication Data

US 2011/0211426 A1 Sep. 1, 2011

(30) Foreign Application Priority Data

Feb. 26, 2010 (EP) ..... 10154766

(51) Int. Cl.
*G04B 25/00* (2006.01)

(52) U.S. Cl.
USPC ..... 368/273; 368/243

(58) Field of Classification Search
USPC ..... 368/243, 244, 269, 273; 116/152–163
See application file for complete search history.

(56) References Cited

U.S. PATENT DOCUMENTS

| | | | | | |
|---|---|---|---|---|---|
| 2,800,870 | A * | 7/1957 | Garthwait, Jr. | ..... | 116/155 |
| 2,929,197 | A * | 3/1960 | Ditisheim et al. | ..... | 368/244 |
| 4,566,400 | A * | 1/1986 | Keenan et al. | ..... | 116/171 |
| 5,975,008 | A * | 11/1999 | Malta | ..... | 116/171 |
| 7,292,505 | B2 * | 11/2007 | Schmiedchen | ..... | 368/110 |

FOREIGN PATENT DOCUMENTS

| | | | |
|---|---|---|---|
| DE | 1 212 894 B | | 3/1966 |
| DE | 1212894 | * | 3/1966 |
| EP | 1 574 917 A2 | | 9/2005 |

OTHER PUBLICATIONS

Search Report issued in corresponding European application 10 15 4766, completed Aug. 16, 2010.

* cited by examiner

*Primary Examiner* — Sean Kayes
(74) *Attorney, Agent, or Firm* — Griffin & Szipl, P.C.

(57) ABSTRACT

The hammer (2) forms part of a striking mechanism (1) of a mechanical watch, which includes at least one gong (11) that can be struck by said hammer. The hammer includes two metal parts (2', 2"), which are secured to each other by welding or soldering. A first part is made of hard metal to form an impact part (2') of the hammer against a gong (11) of the striking mechanism. A second part is a metal heel (2"), particularly made of steel, via which the hammer can be mounted on a plate of the striking mechanism.

17 Claims, 2 Drawing Sheets

HAMMER FOR A WATCH STRIKING MECHANISM

This application claims priority from European Patent Application No. 10154766.9, filed Feb. 26, 2010, the entire disclosure of which is incorporated herein by reference.

FIELD OF THE INVENTION

The invention concerns a hammer for a watch striking mechanism. In the striking mechanism, the hammer is capable of striking at least one striking mechanism gong at determined time periods in order to generate a sound.

BACKGROUND OF THE INVENTION

Within the field of watch-making, a conventional architecture is used to make a movement, which may be provided with a striking mechanism, for example for minute repeaters. For an embodiment of this type, the gong used is a metal wire, for example made of steel, which may be of generally circular shape. This metal wire is arranged around the movement, in the watch frame. The gong is fixed, for example by soldering, to a gong-carrier, which is integral with the bottom plate of the watch. The gong vibration is generated by the impact, generally in proximity to the gong-carrier, of at least one hammer. The sound produced by the gong struck by the hammer is within the audible frequency range from 1 kHz to 20 kHz so as to indicate a well defined time, a programmed alarm time or a minute repeater to the person wearing the watch.

As mentioned above, in a mechanical or electro-mechanical watch, a striking mechanism may include one or more metal wire gongs, configured, for example, in a portion of a circle. Generally, the gong or gongs surround one part of the watch movement. Each gong may be struck by a respective hammer rotatably mounted on the bottom plate of the watch in proximity to the gong-carrier, and held by a spring element in an idle position as shown, for example in EP Patent No. 1 574 917.

In the state of the art, a hammer that is easily made of steel, particularly hardened steel, is always used. This hardened steel hammer is considered sufficiently hard to generate a sound when the hammer strikes the gong. However, with a hardened steel hammer, the acoustic level of the sound generated when the hammer strikes the gong is often not high enough and not crystalline for the watch user, which may be a drawback. Another drawback of the hardened steel hammer is that its volume density is not large enough. Consequently, there is insufficient inertial mass to produce a high acoustic level when the hammer strikes the gong.

SUMMARY OF THE INVENTION

It is thus an object of the invention to overcome the drawbacks of the prior art by providing a hammer for a watch striking mechanism, made such that it increases the acoustic level of the sound produced by the hammer striking the gong.

The invention therefore concerns, in accordance with a first non-limiting embodiment, a hammer for a watch striking mechanism, which includes at least one gong that can be struck by the hammer to produce a sound, wherein the hammer includes two parts secured to each other, namely, a first part that is formed of a harder material than hardened steel to constitute the impact part of the hammer against a gong of the striking mechanism, whereas the second part is a heel via which the hammer can be mounted on a plate of the striking mechanism.

Specific additional non-limiting embodiments of the hammer for a watch striking mechanism are summarized as follows. In accordance with a second non-limiting embodiment of the present invention, the first non-limiting embodiment is modified so that the first impact part of the hammer is made of hard metal, and wherein the first impact part is secured to the metal heel by welding or soldering. In accordance with a third non-limiting embodiment of the present invention, the second non-limiting embodiment is further modified so that the first impact part of the hammer is formed of a hard metal with a hardness of more than 1,000 HV, Vickers Hardness, and preferably more than 1,500 HV. In accordance with a fourth non-limiting embodiment of the present invention, the first non-limiting embodiment is modified so that the material of the first impact part of the hammer is cobalt-tungsten carbide. In accordance with a fifth non-limiting embodiment of the present invention, the first non-limiting embodiment is modified so that the density of the material of the first impact part of the hammer is higher than 10,000 kg/m$^3$ and preferably equal to or higher than 14,700 kg/m$^3$. In accordance with a sixth non-limiting embodiment of the present invention, the first non-limiting embodiment is modified so that the modulus of elasticity of the first, hard metal, impact part of the hammer is greater than 220 GPa, and preferably equal to or greater than 630 GPa.

In accordance with a seventh non-limiting embodiment of the present invention, the first non-limiting embodiment is modified so that the metal heel is made of steel, and wherein a rod is driven into, riveted or bonded onto or through an end portion of the metal heel to act as the rotating shaft of the hammer, when the hammer is mounted on a plate of the striking mechanism. In accordance with an eighth non-limiting embodiment of the present invention, the first non-limiting embodiment is modified so that a rotating rod of the hammer is integral with the metal heel and wherein the metal heel and the rotating rod are made of hardened steel. In accordance with a ninth non-limiting embodiment of the present invention, the seventh and eighth non-limiting embodiments are further modified so that a drive pin of the hammer is driven into or riveted or bonded onto or through the metal heel parallel to the rotating rod of the hammer and between the rotating rod and the first impact part of the hammer. In accordance with a tenth non-limiting embodiment of the present invention, the seventh and eighth non-limiting embodiments are further modified so that a drive pin of the hammer is integral with the metal heel, and the drive pin is parallel to the rotating rod of the hammer and between the rotating rod and the first impact part of the hammer.

In accordance with an eleventh non-limiting embodiment of the present invention, the first non-limiting embodiment is modified so that the volume of the first impact part is larger than the volume of the metal heel. In accordance with a twelfth non-limiting embodiment of the present invention, the second non-limiting embodiment is modified so that the first impact part of the hammer includes an assembly portion in the form of a notch, which is mainly formed of two plane surfaces arranged perpendicularly to each other, and the assembly portion is soldered or welded onto a complementary shaped edge of the metal heel, wherein the complementary shaped edge includes two right-angled surfaces. In accordance with a thirteenth non-limiting embodiment of the present invention, the twelfth non-limiting embodiment is modified so that an inner groove is made in a corner of the notch of the assembly portion of the first impact part to facilitate the positioning and soldering or welding of the first impact part onto the metal heel.

One advantage of the hammer according to this invention lies in the fact that the first impact part of the hammer is made of a harder material than hardened steel and in particular a hard metal. Owing to this first impact part made of hard metal, a more crystalline sound and a higher acoustic level are produced when the gong is struck by the hammer. Until now, the possibility of making a hammer with a first impact part made of a material of great hardness, secured to a metal heel made of hardened steel, has never been imagined. Since the first, hard metal, impact part is very difficult to work and may be brittle, it is easy to drive, rivet or bond a rotating rod of the hammer into or onto a plate of the striking mechanism and/or a drive pin of the hammer on or through an end portion of the hardened steel heel.

Advantageously, the density of the material of the first impact part is higher than the density of the metal heel material. Moreover, the volume dimensions of the first impact part are much larger than those of the metal heel so that the hammer has a significant inertial mass even in the restricted space available inside the watch. Owing to the large inertial mass of the hammer, the gong can be struck by the hammer with maximum energy.

Advantageously, a rotating rod of the hammer and/or a drive pin of the hammer can be driven in, riveted or bonded to or through an end portion of the metal heel, after the first impact part has been positioned on and secured to the metal heel. Preferably, the first impact part of the hammer is welded or soldered to an edge of the metal heel. After the first impact part has been positioned on and secured to the metal heel, one or more holes, for example through holes, can then be made in the metal heel, and the holes are well positioned and well oriented relative to the main body of the hammer. The rotating rod and/or the drive pin can subsequently easily be driven into or bonded in a corresponding hole in the metal heel.

Advantageously, the first impact part of the hammer is made using a hard metal with a hardness of more than 1,000 HV, and preferably more than twice the hardness of hardened steel. This hard metal may be cobalt-tungsten carbide. It is also possible to imagine a first impact part of the hammer made of ceramic material or even diamond. Further, both the density and the modulus of elasticity of the hard metal selected can be close to two times greater than the density and modulus of elasticity of hardened steel. The first impact part made of material with very high hardness is thus scratchproof and very resistant to oxidation.

BRIEF DESCRIPTION OF THE DRAWINGS

The objects, advantages and features of the hammer for a watch striking mechanism will appear more clearly in the following description, particularly with reference to the drawings, in which.

DETAILED DESCRIPTION OF THE INVENTION

The following description will describe only briefly all those parts of the watch striking mechanism, provided with a hammer for striking at least one gong, which are well known in this technical field.

Figure 1:
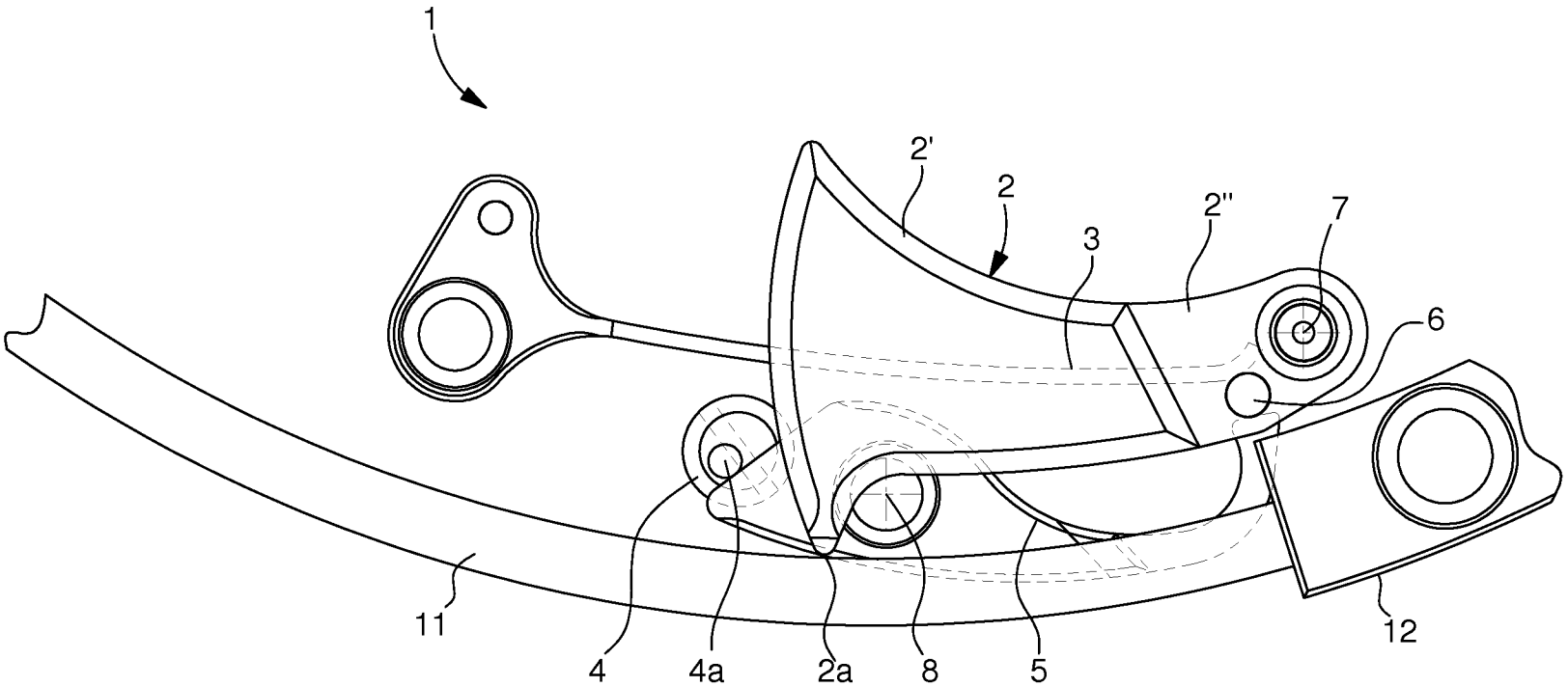
FIG. 1 shows a simplified view of a watch striking mechanism, which is provided with a hammer according to the invention for striking a gong of the striking mechanism.

FIG. 1 shows in a simplified manner a striking mechanism 1, which includes at least one gong 11 connected to a gong-carrier 12 which may be secured to a plate of the striking mechanism (not shown). A hammer 2 of the striking mechanism is rotatably mounted about an arbour 7 on the plate in proximity to gong-carrier 12. This hammer strikes the gong 11 to generate a sound indicating for example the hours, minutes or a programmed alarm time. Gong 11 can be made in the form of a portion of a circle, for example by means of a metal wire, generally made of steel, or also of a precious metal or metallic glass. This portion of a circle conventionally surrounds a part of the watch movement (not shown).

Hammer 2 generally includes two parts 2' and 2", which are secured to each other. A first impact part 2' of the hammer is formed of a harder material than hardened steel and with a higher density. This first impact part 2', which is preferably made of hard metal, is used for striking, via a rounded edge 2*a*, at least one gong 11 of striking mechanism 1. A second part forms a heel 2" via which hammer 2 can be mounted on a plate of the striking mechanism. This heel 2" is preferably made of metal material, such as hardened steel. First impact part 2' is advantageously secured to metal heel 2" by soldering or welding as explained below with reference to FIGS. 2 and 3.

Rod 7 for rotating hammer 2 on the plate is preferably driven into a through hole of slightly smaller diameter than rod 7. This through hole is made in an end portion of metal heel 2". This rod 7 may also be made of metal, such as hardened steel. Rod 7 is rotatably mounted on an aperture of the plate (not shown), to form the rotating shaft of hammer 2 on the plate.

Of course, rotating rod 7 may also be riveted or bonded onto or through a hole in an end portion of metal heel 2". This rod may also be integral with the metal heel to form a single part.

For striking mechanism 1, the first impact portion 2' of hammer 2 is kept idle at some distance from gong 11 by a damping unit 4, 4*a* and 5. This damping unit includes, in a known manner, a lever 5 rotatably mounted about an arbour 8 secured to the plate of the watch striking mechanism, and an adjusting wheel 4. A pin 4*a* is placed off-centre on the adjusting wheel. This pin is in contact with one surface of a first cam-shaped end of the lever. The other arched end of lever 5 holds hammer 2 in an idle position via a drive pin 6. This drive pin 6 is secured to the metal heel 2" of the hammer. This drive pin may advantageously be driven into a through hole made in the heel between rod 7 and first impact part 2'. The distance, in the idle position, between rounded edge 2*a* of first impact portion 2' of the hammer and gong 11 can be adjusted by means of wheel 4 with off-centre pin 4*a* in contact with the surface of the first end of lever 5.

To produce a vibration of the struck gong, hammer 2 is pushed abruptly on its drive pin 6 in the direction of gong 11 by a free end of a spring 3. This spring 3 is pre-wound via a lifting element (not shown). The damping unit, particularly the arched part of lever 5 which can bend, must also be made such that it prevents the hammer striking the gong twice after the action of wound spring 3. To achieve this, the damping unit can be made for example of a hard metal whose modulus of elasticity is around three times that of conventional hardened steel. The elastic deformation of the damper is three times lower for a given stress.

According to the invention, the first impact part 2' of hammer 2 is made of a harder material than hardened steel, which has a hardness of around 650 HV. This material of very high hardness may advantageously be a hard metal with a hardness of more than 1,000 HV. One example of a hard metal is cobalt-tungsten carbide (WCCo), which has a hardness of around 1,540 HV.

The density of the material of this first impact part 2' of the hammer 2 must also be high for the hammer to have a large inertial mass. This density must be higher than that of hardened steel, which is around 8,000 kg/m$^3$. If the density of the material selected for the first impact part 2' is high, for example higher than 10,000 kg/m$^3$, the energy upon impact of hammer 2 against gong 11 increases with a given hammer speed. Preferably, the density of the selected material, such as hard metal, must be at least between 1.5 and 2 times greater than that of hardened steel, for example equal to or higher than 14,700 kg/m$^3$.

The first impact part 2' of hammer 2 may also be made of a hard material whose modulus of elasticity is higher than that of hardened steel, which is around 220 GPa. Preferably, this modulus of elasticity of the material used to manufacture the hammer may be higher than 500 GPa, in particular higher than or equal to 630 GPa. If the modulus of elasticity of the material of hammer 2 is high, it is possible to minimise the elastic deformation of the hammer upon impact against the gong for a given stress. This also minimises internal losses due to deformation. When this material forms the first impact part 2' of the hammer, the acoustic level of the sound produced when the hammer strikes gong 11 is increased, which is the desired objective.

To explain how this hammer is made, reference will now be made to FIGS. 2 and 3, which show, on the one hand, the two assembled parts 2' and 2" of hammer 2 in a top view, and on the other hand, a partial cross-section of hammer 2 along the line III-III of FIG. 2.

Figure 2:
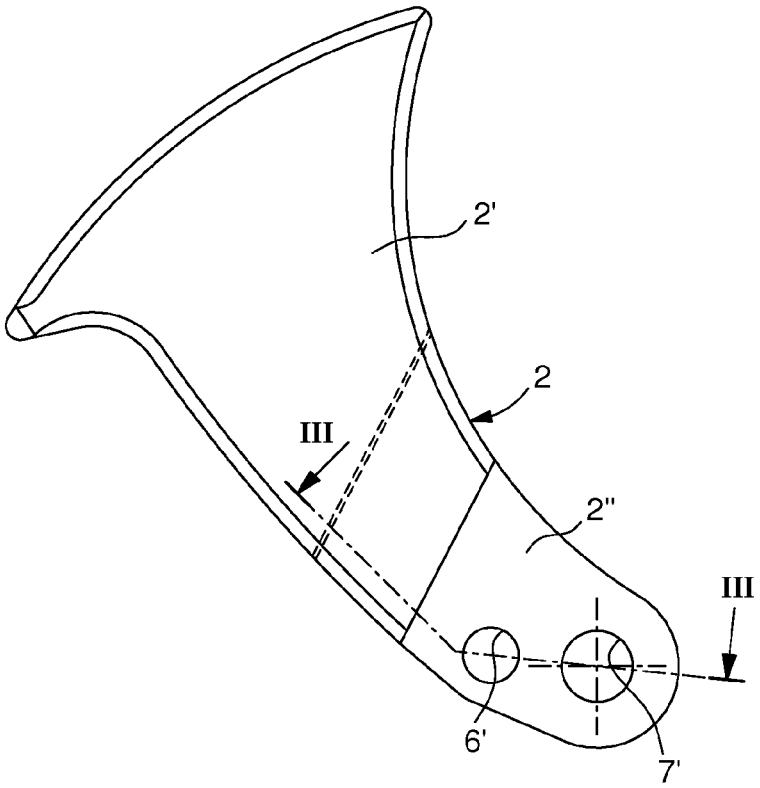
FIG. 2 shows a more detailed top view of the two assembled parts of the hammer according to the invention for a watch striking mechanism.

In FIG. 2, the hybrid hammer 2 essentially includes two parts 2' and 2" assembled to each other. Preferably, the first impact part 2' of the hammer is made of a harder material than the hardened steel conventionally used for making a hammer for a watch striking mechanism. This first impact part 2' is preferably a hard metal, such as cobalt-tungsten carbide (WCCo), with a hardness of around 1,540 HV and a density higher than 14,700 kg/m$^3$. For hammer 2 to have a high inertial mass, the first impact part 2' must have a larger volume than the volume of the second part, which is a metal heel 2". This first, hard metal, impact part 2' can advantageously be soldered or welded to metal heel 2" of the hammer. The edge of metal heel 2" and the assembly portion of the first impact part 2' are represented by the two parallel dotted lines in FIG. 2.

Since the first impact part 2' is made of hard metal, this first impact part is difficult to work and may be brittle. The first impact part is thus advantageously welded or soldered to metal heel 2", made of hardened steel, in which it is easier to make holes for securing a rotating rod or drive pin. The assembly portion of the first impact part 2' is first of all welded or soldered onto an edge of metal heel 2". Afterwards, it is easy to make a first hole 7' for receiving a rotating rod of the hammer on the plate, and a second hole 6' for receiving a drive pin of the hammer. These two holes 6' and 7' are well positioned and well oriented relative to the main body of hammer 2 in accordance with the position of the first impact part secured to the metal heel.

Figure 3:
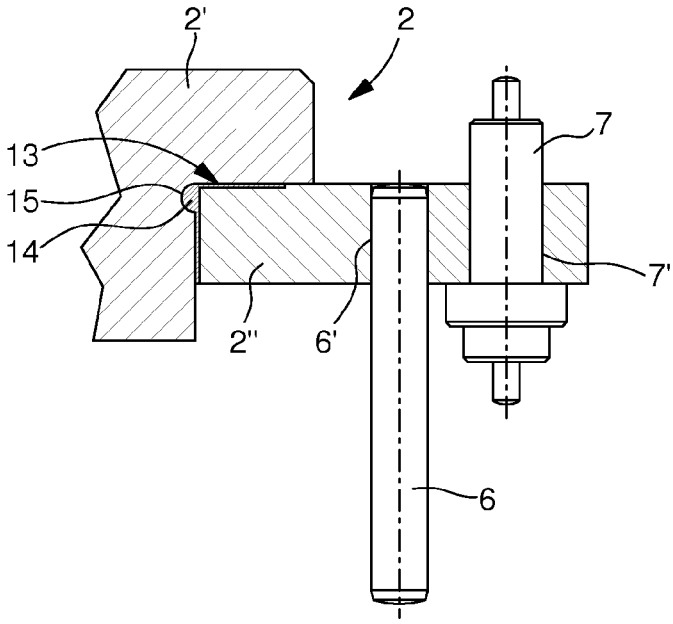
FIG. 3 shows a partial cross-sectional view, along the line III-III of FIG. 2, of the hammer according to the invention for a watch striking mechanism.

FIG. 3 shows clearly the assembly portion of the first impact part 2' welded or soldered by a metal material 14 to an edge of metal heel 2". The assembly portion of the first impact part 2' takes the form of a notch 13, which is mainly formed of two plane surfaces arranged for example perpendicularly to each other. This assembly portion is welded or soldered onto an edge of complementary shape, which includes two surfaces for example at right angles, of metal heel 2". To facilitate positioning, and the welding or soldering of first impact part 2' to metal heel 2", an inner groove 15 is made in a corner of notch 13 of the first impact part assembly portion.

Of course, the shape of the edge or the assembly portion may be different from that described above provided that it is easy to secure the first impact portion 2' to metal heel 2" by welding or soldering or any other means. It is possible to envisage screwing the first impact part to the metal heel, but this requires making at least one hole, with difficulty, in the hard material of the first impact part. Further, the first impact part can be secured to the metal heel by a dovetail fitting.

Once the first impact part 2' is secured to metal heel 2", holes 6' and 7' are made in the heel for receiving drive pin 6 and rotating rod 7. Preferably, chamfered pin 6 and chamfered rotating rod 7 are driven into each corresponding hole 6' and 7' of slightly smaller diameter. Pin 6 and rod 7 may also be bonded in each corresponding hole or onto the heel without making any holes, or also riveted to the metal heel. As far as possible, it may also be envisaged to make the rod and pin integral with the metal heel before the heel 2" is fixed to the first impact part 2'.

From the description that has just been given, several variants of the hammer for a mechanical or electro-mechanical watch striking mechanism can be devised by those skilled in the art without departing from the scope of the invention defined by the claims. The hard material of the first impact part of the hammer may also be ceramic or diamond, but, in such case, an additional weight must be placed on the first part. However, in general, the invention pertains broadly to a hammer (2) that forms part of a striking mechanism (1) of a mechanical watch, wherein the watch includes at least one gong (11) that can be struck by the hammer. The hammer includes two metal parts (2', 2"), which are secured to each other by welding or soldering. A first part is made of hard metal to form an impact part (2') of the hammer against a gong (11) of the striking mechanism. A second part is a metal heel (2"), particularly made of steel, via which the hammer can be mounted on a plate of the striking mechanism.

What is claimed is:

1. A hammer for a watch striking mechanism, wherein the watch striking mechanism includes at least one gong that can be struck by the hammer to produce a sound, wherein the hammer includes a first impact part that strikes the at least one gong, wherein the first impact part is formed of a hard material with a hardness of more than 1,000 HV, Vickers Hardness, and a second part that is a heel made of hardened steel via which the hammer is mountable on a plate of the striking mechanism, and wherein the first impact part and the second part are secured to each other by welding or soldering.

2. The hammer according to claim 1, wherein the first impact part of the hammer is formed of a hard metal with a hardness of more than 1,500 HV.

3. The hammer according to claim 1, wherein the material of the first impact part of the hammer is cobalt-tungsten carbide.

4. The hammer according to claim 1, wherein density of the material of the first impact part of the hammer is higher than 10,000 kg/m$^3$.

5. The hammer according to claim 4, wherein the density of the material of the first impact part of the hammer is equal to or higher than 14,700 kg/m$^3$.

6. The hammer according to claim 1, wherein a modulus of elasticity of the hard metal of the first impact part of the hammer is greater than 220 GPa.

7. The hammer according to claim 6, wherein the modulus of elasticity of the hard metal of the first impact part of the hammer is equal to or greater than 630 GPa.

8. The hammer according to claim 1, wherein a rotating rod is driven into, riveted or bonded onto or through an end portion of the metal heel to act as a rotating shaft of the hammer, when the hammer is mounted on the plate of the striking mechanism.

9. The hammer according to claim 8, wherein a drive pin of the hammer is integral with the metal heel, wherein the pin is parallel to the rotating rod of the hammer and between the rotating rod and the first impact part of the hammer.

10. The hammer according to claim 1, wherein a rotating rod of the hammer is integral with the heel made of hardened steel, and wherein both the heel and the rotating rod are made of hardened steel.

11. The hammer according to claim 10, wherein a drive pin of the hammer is driven into or riveted or bonded onto or through the metal heel parallel to the rotating rod of the hammer and between the rotating rod and the first impact part of the hammer.

12. The hammer according to claim 10, wherein a drive pin of the hammer is driven into or riveted or bonded onto, or through, the heel made of hardened steel parallel to the rotating rod of the hammer and between the rotating rod and the first impact part of the hammer.

13. The hammer according to claim 10, wherein a drive pin of the hammer is integral with the heel made of hardened steel, and the drive pin is parallel to the rotating rod of the hammer and between the rotating rod and the first impact part of the hammer.

14. The hammer according to claim 1, wherein a volume of the first impact part is larger than a volume of the heel made of hardened steel.

15. The hammer according to claim 1, wherein the first impact part of the hammer includes an assembly portion comprising a notch, wherein the notch mainly comprises two plane surfaces arranged perpendicularly to each other, wherein the assembly portion is soldered or welded onto a complementary shaped edge of the heel made of hardened steel, and the complementary shaped edge includes two right-angled surfaces.

16. The hammer according to claim 15, wherein an inner groove is made in a corner of the notch of the assembly portion of the first impact part to facilitate the positioning and soldering or welding of the first impact part onto the heel made of hardened steel.

17. A watch striking mechanism includes:

(a) at least one gong; and (b) a hammer disposed to strike the at least one gong in order to produce a sound, wherein the hammer includes i. a first impact part that strikes the at least one gong, wherein the first impact part is formed of a hard material with a hardness of more than 1,000 HV, Vickers Hardness; and ii. a second part that is a heel made of hardened steel via which the hammer is mounted on a plate of the watch striking mechanism, and wherein the first impact part and the second part are secured to each other by welding or soldering.

* * * * *